US008327674B2

(12) United States Patent
Valerio et al.

(10) Patent No.: US 8,327,674 B2
(45) Date of Patent: Dec. 11, 2012

(54) LOCKING MECHANISM, FOR A PADLOCK FOR EXAMPLE, IN WHICH A SHACKLE CAN BE SEVERED FOR LUGGAGE INSPECTION AND THEN RELOCKED

(75) Inventors: Theodore Valerio, Carine (AU); Stephen Payne, Parkerville (AU)

(73) Assignee: Origineering Pty Ltd, Carine, Western Australia (AU)

( * ) Notice: Subject to any disclaimer, the term of this patent is extended or adjusted under 35 U.S.C. 154(b) by 0 days.

(21) Appl. No.: 13/218,618

(22) Filed: Aug. 26, 2011

(65) Prior Publication Data

US 2012/0011909 A1 Jan. 19, 2012

Related U.S. Application Data

(63) Continuation of application No. PCT/AU2010/000222, filed on Feb. 26, 2010.

(30) Foreign Application Priority Data

Feb. 27, 2009 (AU) ..... 2009900866
Sep. 25, 2009 (AU) ..... 2009904672

(51) Int. Cl.
*E05B 67/22* (2006.01)

(52) U.S. Cl. ..... 70/38 B; 7/38 A; 7/38 C; 7/38 R; 7/21; 7/24; 7/58

(58) Field of Classification Search ..... 70/21, 24–26, 70/284, 285, DIG. 65, 38 R, 38 A–38 C
See application file for complete search history.

(56) References Cited

U.S. PATENT DOCUMENTS 1,452,393 A * 4/1923 Shek ..... 70/38 C
1,477,777 A * 12/1923 Shek ..... 70/38 C
1,690,938 A * 11/1928 Maxwell ..... 70/53
1,696,061 A * 12/1928 Soley ..... 70/26
2,479,199 A * 8/1949 Bennett et al. ..... 70/50
(Continued)

FOREIGN PATENT DOCUMENTS

GB 1296852 A 11/1972
(Continued)

OTHER PUBLICATIONS

International Search Report from PCT/AU2010/000222, filed Feb. 26, 2010, mailed Apr. 28, 2010.

*Primary Examiner* — Suzanne Barrett
*Assistant Examiner* — Ifeolu Adeboyejo
(74) *Attorney, Agent, or Firm* — Patentbar International, P.C.

(57) ABSTRACT

A locking mechanism (10) comprising a housing (16) and a shackle (14) having a first side (44) and a second side (46). The shackle (14) is slidable between a primary closed position in which the first and second sides (44 and 46) are each engaged with the housing (16) and a primary open position in which the first side (44) is engaged with the housing (16) and the second side (46) is free from the housing (16). A port (65) is provided in the housing (16) exposing a portion of the first side (44) of the shackle (14) in the primary closed position. Severing the shackle (14) through the port (65) allows the shackle (14) to move from the primary open position to a secondary open position, from which the shackle (14) can move back to a secondary closed position.

15 Claims, 17 Drawing Sheets

U.S. PATENT DOCUMENTS

| | | | | |
|---|---|---|---|---|
| 3,084,532 | A * | 4/1963 | Williams | 70/63 |
| 6,119,493 | A * | 9/2000 | Carter et al. | 70/26 |
| 6,622,538 | B2 | 9/2003 | Prunbauer et al. | |
| 7,121,124 | B1 * | 10/2006 | Whinery | 70/38 C |
| 7,152,439 | B1 * | 12/2006 | Chang | 70/30 |
| 7,424,812 | B2 * | 9/2008 | Loughlin et al. | 70/56 |
| 7,631,524 | B2 * | 12/2009 | Araujo | 70/25 |
| 2008/0209956 | A1 | 9/2008 | Araujo | |
| 2008/0250825 | A1 * | 10/2008 | Lai | 70/25 |
| 2011/0079054 | A1 * | 4/2011 | Loughlin et al. | 70/21 |

FOREIGN PATENT DOCUMENTS

| | | | |
|---|---|---|---|
| GB | 2426282 | A | 11/2006 |
| GB | 2448403 | A | 10/2008 |
| WO | 9637677 | A1 | 11/1996 |
| WO | 2008061287 | A1 | 5/2008 |

* cited by examiner

LOCKING MECHANISM, FOR A PADLOCK FOR EXAMPLE, IN WHICH A SHACKLE CAN BE SEVERED FOR LUGGAGE INSPECTION AND THEN RELOCKED

RELATED APPLICATIONS

This Application is a Continuation application of International Application PCT/AU2010/000222, filed on Feb. 26, 2010, which in turn claims priority to Australian Patent Applications No. AU 2009904672, filed Sep. 25, 2009 and AU 2009900866, filed Feb. 27, 2009, all of which are incorporated herein by reference in their entirety.

FIELD OF THE INVENTION

The present invention relates to a locking mechanism for application in devices that can be opened with a key, such as padlocks.

BACKGROUND OF THE INVENTION

Many products employ a locking mechanism in which unauthorised access is prevented unless the person trying to access the product has an appropriate key device. The most common locking mechanism available is the pin tumbler mechanism used on standard cylinder locks. While this mechanism is relatively easily produced, its workings are well known and it is susceptible to a number of known techniques such as picking, bumping, raking and drilling.

The present invention is aimed at providing an improved locking mechanism which includes improved resistance to the abovementioned techniques. The locking mechanism of the present invention is also aimed at providing a relatively simple mechanical lock which allows for a large number of key permutations.

A further issue relates to the ability of security staff in locations such as airports to be able to access an item of luggage that has been secured with a locking device. It is common for random checks to be made of luggage and locking devices securing inspected luggage are generally opened by simply cutting a shackle of the lock with a pair of bolt cutters. The present invention relates also to a locking mechanism for use on a locking device such as a padlock that allows the device to be opened by common tools such as bolt cutters, allows the device to then be re-locked after opening and provides also a visual indication that the locking device has been opened for inspection.

SUMMARY OF THE INVENTION

According to one aspect of the present invention there is provided a locking mechanism comprising:

a housing;

a shackle having a first side and a second side, the shackle being slidable between a primary closed position in which the first and second sides are each engaged with the housing and a primary open position in which the first side is engaged with the housing and the second side is free from the housing; and a port in the housing exposing a portion of the first side of the shackle in the primary closed position;

wherein severing the shackle through the port allows the shackle to move from the primary open position to a secondary open position, from which the shackle can move back to a secondary closed position.

Preferably the locking mechanism further comprises:

a primary latch member that engages with the shackle in the primary closed position and is releasable from the shackle by operation with a key; and a secondary latch member that is disengaged from the shackle in the primary open and closed positions;

wherein severing of the shackle and movement of the shackle to the secondary open position releases the secondary latch member such that the secondary latch member is free to engage with the shackle when the shackle moves to the secondary closed position.

Preferably the shackle can be opened from the secondary closed position by operation with the key and the shackle can then be removed from the housing for replacement.

Preferably the first side of the shackle is longer than the second side and the primary latch member is slidable in a slot in the housing in a direction perpendicular to that of the first side of the shackle such that when the shackle moves to the primary closed position, a first end of the primary latch member is received in a first notch in the first side of the shackle adjacent the end thereof.

The primary latch member preferably includes a primary latch spring arranged in the slot to bias the primary latch member to move towards the first side of the shackle. In one embodiment, the first notch includes tapered sides such that when the shackle slides from the primary closed position, the primary latch member can ride up out of the first notch.

Further, a slide member is preferably provided, the slide member being moveable between a first locked position and a second unlocked position by insertion of the key into the housing and wherein in the first locked position the slider engages with the primary latch member to prevent the primary latch member moving out of the first notch, thereby preventing the shackle moving to the primary open position.

In a preferred embodiment, the slide member comprises a slidable bar, the first end of which engages with a distal end of the second side of the shackle when moving to the second unlocked position to move the shackle towards the primary open position.

Preferably the second end of the bar engages with the primary latch member in the primary closed position to prevent movement of the primary latch member out of the first notch.

The locking mechanism may further comprise:

a slot extending between the first and second sides of the shackle into which the secondary latch member is slidably located;

a cut out portion in the secondary latch member such that the second side of the shackle engages through the cut out portion when in the primary closed position;

a secondary latch spring; and a second notch provided in the first side of the shackle;

wherein movement of the bar to the locked position thereof moves the secondary latch spring to apply a force to move the secondary latch member towards the first side of the shackle and moving the severed portion of the shackle releases the secondary latch member to move towards the first side of the shackle where it can engage in the second notch when moved back to the secondary closed position.

In one embodiment the housing includes first and second end walls and first and second side walls and the first end wall includes first and second recesses for receiving the first and second sides of the shackle. The first recess may be located adjacent the second side wall, the second recess adjacent the first side wall and the port located in the second side wall.

Preferably the bar is located adjacent the first side wall being collinear with the second side of the shackle and the first side wall is provided with a key slot for receiving the key to engage with and release the bar from the locked position to the unlocked position. A shackle retainer is preferably provided to retain the severed shackle in the housing.

In a preferred embodiment, the shackle retainer comprises a flexible strip of material, a first end of which is secured inside the housing and a second end of which rests against the first side of the shackle in a thinned portion thereof such that when the severed shackle moves outwardly of the housing, the second end engages with the edge of the thinned portion to prevent complete removal of the shackle from the housing.

In accordance with a second aspect of the present invention, there is provided a locking mechanism comprising:

one or more lock wafers slidably mounted in a housing, each wafer having an opening therein at a location along the length thereof;

a slide member mounted to slide longitudinally within the housing, the slide member having raised portions along the length thereof;

an associated key having engaging portions to engage with each of the wafers; and a release mechanism in communication with the slide member;

wherein the engaging portions of the associated key engage with and move the wafers such that the openings of each wafer align with the raised portions of the slide member allowing the slide member to slide longitudinally from a locked position to an unlocked position, thereby actuating the release mechanism.

The slide member preferably comprises a bar that passes through the openings. Preferably each of the wafers is located in a slot in the housing and a wafer spring is provided between a first end of the slot and the associated wafer such that engagement of the wafers by the key compresses the wafer springs.

In one embodiment, each wafer comprises a generally flat rectangular plate and each opening extends along at least a portion of the length thereof. The key preferably comprises a flat card and the engaging portions comprise cut out portions each set back a distance from a first edge of the key such that the each wafer is moved a preset distance by the respective cut out portion to align the openings in the wafers.

In one embodiment, the locking mechanism is provided on a padlock comprising: a housing;

a shackle having a first side and a second side, the shackle being slidable between a closed position in which the first and second sides are each engaged with the housing and an open position in which the first side is engaged with the housing and the second side is free from the housing.

There is preferably provided a first notch in the first side of the shackle and a primary latch member such that an end of the primary latch is received in the first notch when the shackle is in the closed position and the bar engages with the primary latch member when in the locked position to prevent the primary latch member moving out of the first notch, thereby preventing the shackle moving to the open position.

Preferably the primary latch member includes a primary latch spring arranged in the slot to bias the primary latch member to move towards the first side of the shackle. Preferably first notch includes tapered sides such that when the shackle slides from the primary closed position, the primary latch member can ride up out of the first notch.

BRIEF DESCRIPTION OF THE DRAWINGS

The invention will now be described, by way of example, with reference to the following drawings.

DETAILED DESCRIPTION OF THE PREFERRED EMBODIMENTS

Figure 1B:
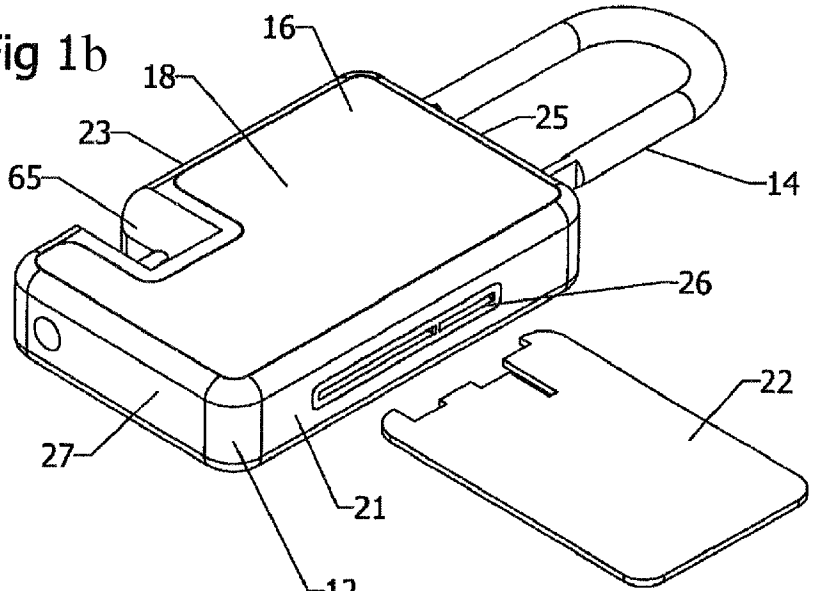
FIG. 1*b* is an upper perspective view of the padlock and key of FIG. 1.
Figure 1A:
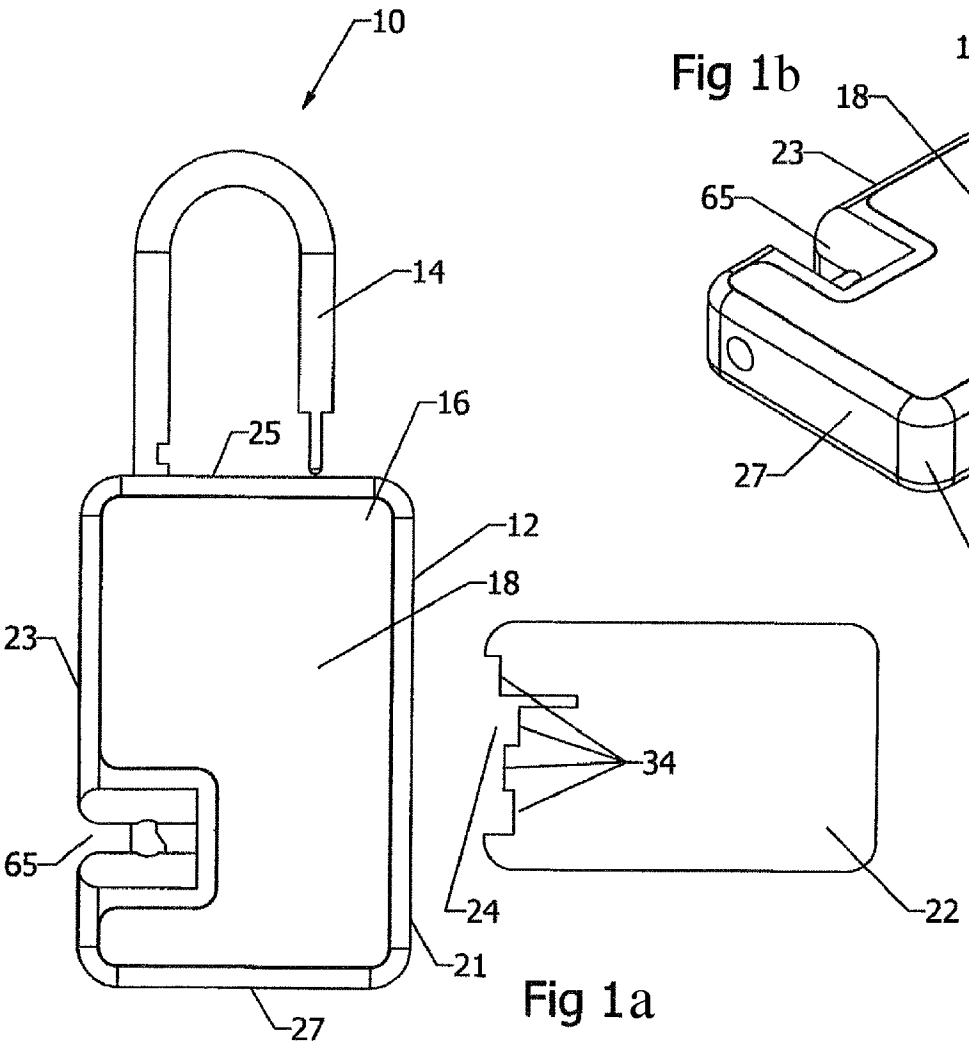
FIG. 1*a* is a front view of a padlock and key utilising the locking mechanism of present invention in the primary open position.

Referring to Figures there is shown a first embodiment of a locking mechanism 10 for use on a lockable device having a securing member moveable between a locked condition and an unlocked condition. In the embodiment shown, the locking device comprises a padlock 12 and the securing member comprises a shackle 14 moveable between an open position and a closed position. It will be appreciated that while the locking mechanism 10 has been shown in a padlock, the locking mechanism may be applied to other lockable devices.

The padlock 12 comprises a relatively flat housing 16. The housing 16 includes an outer frame comprising first and second parallel side walls 21 and 22 interconnected by first and second parallel end walls 25 and 27 at opposite ends thereof. A first cover member 18 is provided to extend between the first and second side walls 21 and 23 and the first and second end walls 25 and 27 on a first side thereof. A second cover member 20 is provided to extend between the first and second side walls 21 and 23 and the first and second end walls 25 and 27 on a second side thereof.

The locking mechanism 10 of the present invention is opened with a relatively flat key 22. The key 22 in the embodiment shown comprises a rectangular card having a first edge 24 which can be received in key slot 26 in the padlock 12. In the embodiment shown, the key slot 26 is located in the first side wall 21. The shackle 14 extends outwardly from the first end wall 25.

The locking mechanism 10 includes a plurality of lock wafers 28 within the housing 16. The lock wafers 28 are generally flat rectangular plates mounted in slots 30 in the housing such that the wafers 28 may slide longitudinally within the slots 30. Associated with each wafer 28 is a wafer spring 32. The wafer springs 32 are provided in each slot between a lug 29 provided on the associated wafer 28 and first end of the slot 30 such that when a wafer 28 is moved towards the first end of the slot 30, the wafer 28 compresses the wafer spring 32.

The key slot 26 is arranged such that when the first edge 24 of the key 22 is inserted into the key slot 26, the first edge 24 engages with the wafers 28, moving the wafers 28 towards the first end of the slots 30. The first edge 24 of the key 22 includes a plurality of engaging portions 34, each engaging portion being associated with one of the wafers 28. The engaging portions 34 are each set back a distance from the edge 24 of the key 22 such that the wafers 28 are each moved a preset distance by the key 22 when the key 22 is inserted.

In the embodiment shown, the engaging portions 34 comprise cut out portions in the first edge 24. In an alternative embodiment (not shown), the engaging portions may comprise protrusions provided on the surface of the card adjacent the first edge 24.

Figure 2:
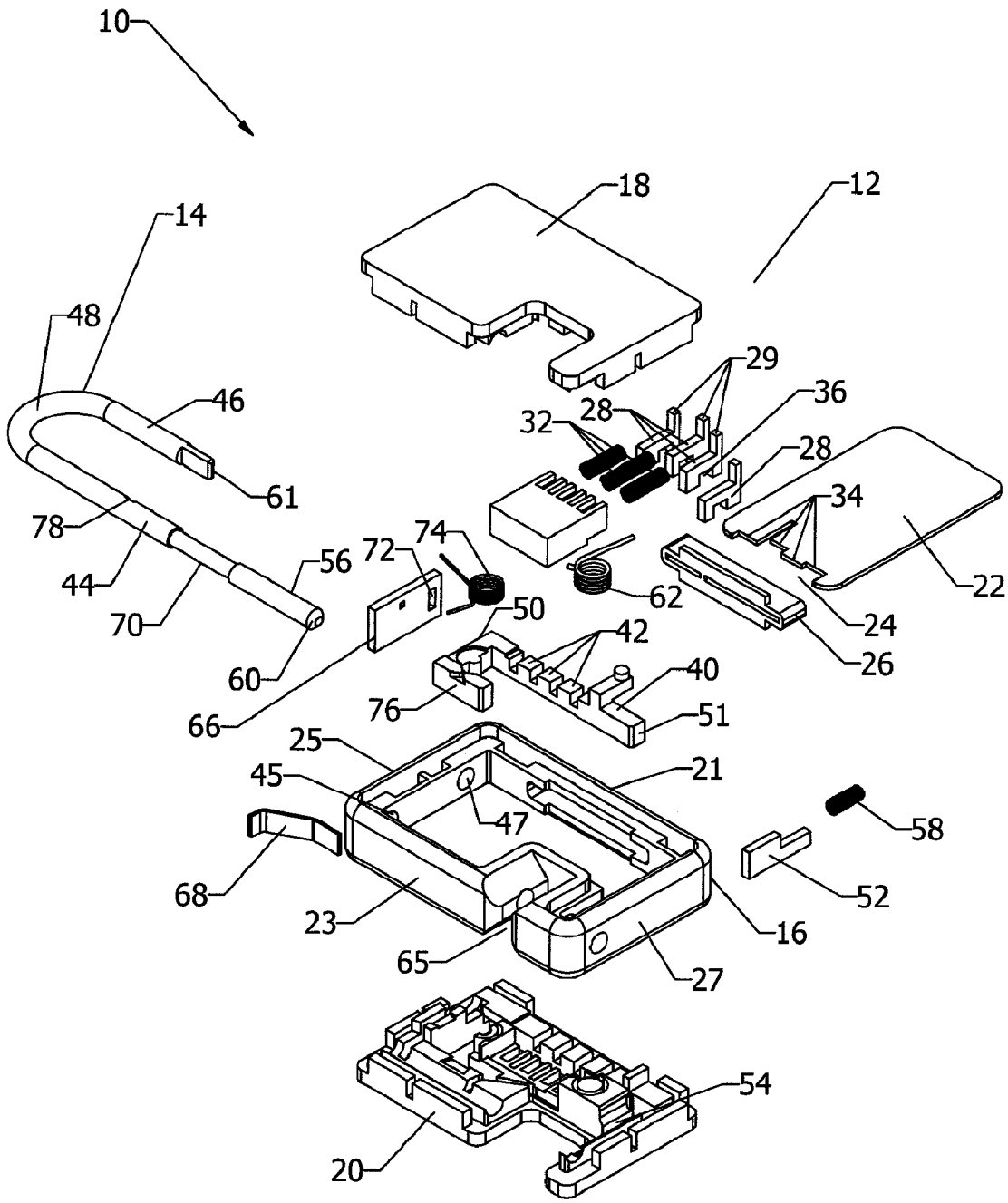
FIG. 2 is an exploded view of the padlock of FIG. 1.

Each of the wafers 28 includes an opening 36 (as best seen in FIG. 2). Each opening 36 is provided along at least a portion of the length of the wafer 28 at a location along the length thereof. The locking mechanism 10 includes also a slide member comprising a bar 40 which is arranged transversely to the wafers 28. The bar 40 includes raised portions 42 along the length thereof that are located between the wafers 28 in the locked position. The raised portions 42 are dimensioned such that they can pass only through the openings 36 in the wafers 28. Therefore, the bar 40 is free to slide longitudinally only if the wafers 28 are moved such that all of the openings 36 line up with the bar 40. The engaging portions 34 of the key 22 associated with the locking mechanism 10 are set so that this occurs by inserting the edge 24 into the key slot 26. A release mechanism is provided such that sliding of the bar 40 when the key 22 is inserted causes the padlock to move to the primary open position.

The shackle 14 comprises a first side 44 received in a first recess 45 in the housing 16 and a second side 46 received in a second recess 47 in the housing 16. The first and second sides 44 and 46 each comprise an elongate member and are joined by a U-shaped interconnecting portion 48. The first recess 45 extends through the length of the housing 16 from the first end wall 25 to the second end wall 27.

The first side 44 of the shackle 14 is longer than the second side 46 such that the first side 44 extends further through the housing 16 than the second side 46. The second recess 47 and therefore the second side 46 of the shackle 14 is collinear with the bar 40 such that, in use, the second side 46 of the bar 40 can contact a first end 50 of the bar 40 when the shackle 14 moves to the closed position.

In the closed configuration, both of the first and second sides 44 and 46 are received in the respective recesses 45 and 47. In the open configuration, the shackle 14 slides away from the housing 16 and the second side 46 exits the second recess 47 such that the shackle 14 is open in the manner of a standard padlock.

A primary latch member 52 is provided in the housing 16 to engage with the first side 44 of the shackle 14 such that the primary latch member 52 can hold the shackle 14 in a primary closed position. The primary latch member 52 is slidable in a slot 54 in the housing 16 in a direction perpendicular to that of the first side 44 of the shackle 14. The primary latch member 52 includes a primary latch spring 58 provided to bias the primary latch member 52 to move towards the first side 44 of the shackle 14. When the shackle 14 moves to the primary closed position, a first end of the primary latch member 52 is received in a first notch 56 in the first side 44 of the shackle 14 adjacent the end thereof.

The first notch 56 includes tapered sides such that when the shackle 14 slides from the primary closed position, the primary latch member 52 can ride up out of the first notch 56. The bar 40 however is arranged to prevent the primary latch member 52 from sliding away from the first side 44 of the shackle 14 when in the primary closed position.

Figure 3:
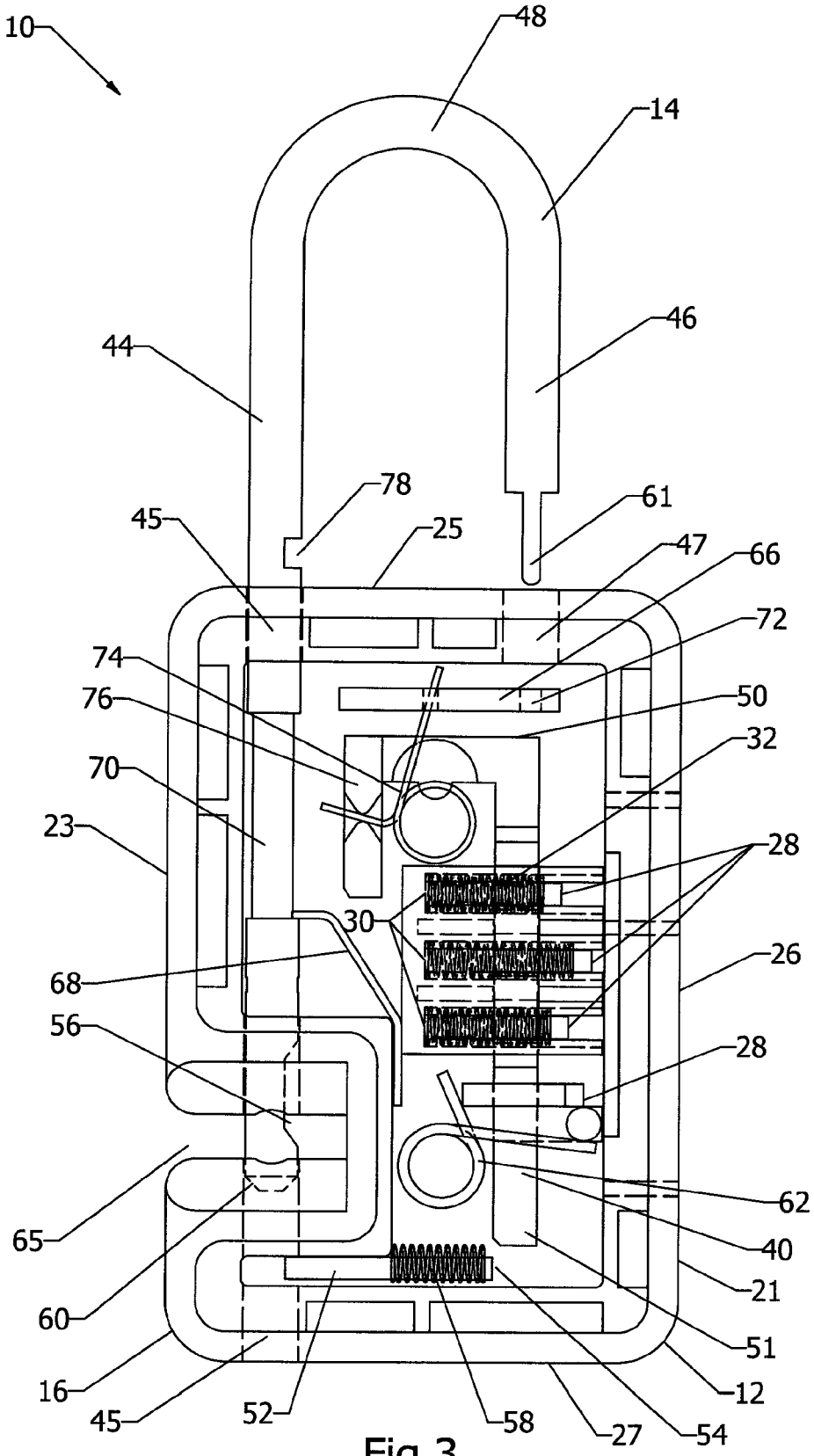
FIG. 3 is a front cross sectional view of the padlock of FIG. 1 in the primary open position.
Figure 4:
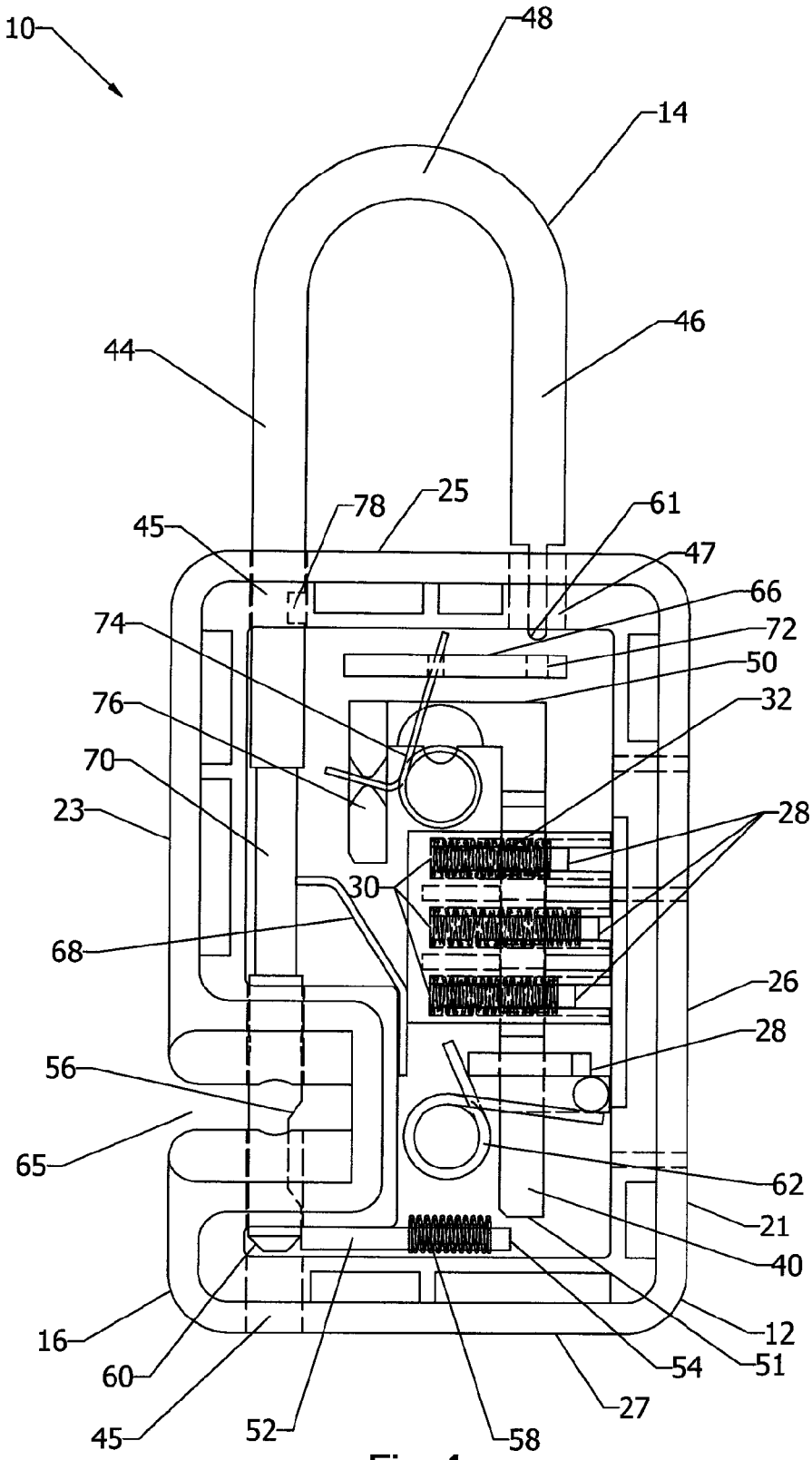
FIG. 4 is a front cross sectional view of the padlock of FIG. 1 in a first step of the primary closing process.
Figure 5:
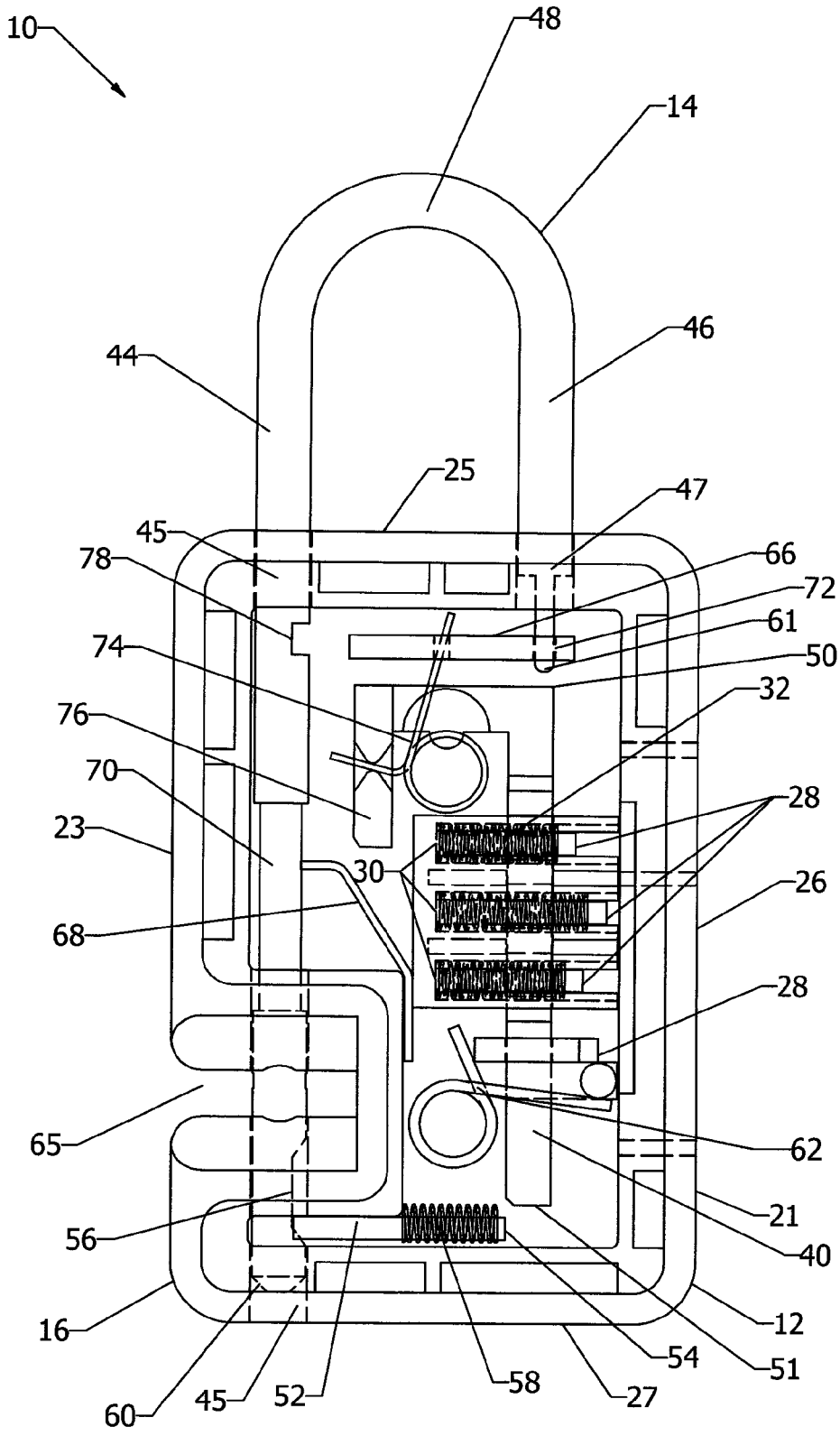
FIG. 5 is a front cross sectional view of the padlock of FIG. 1 in a second step of the primary closing process.
Figure 6:
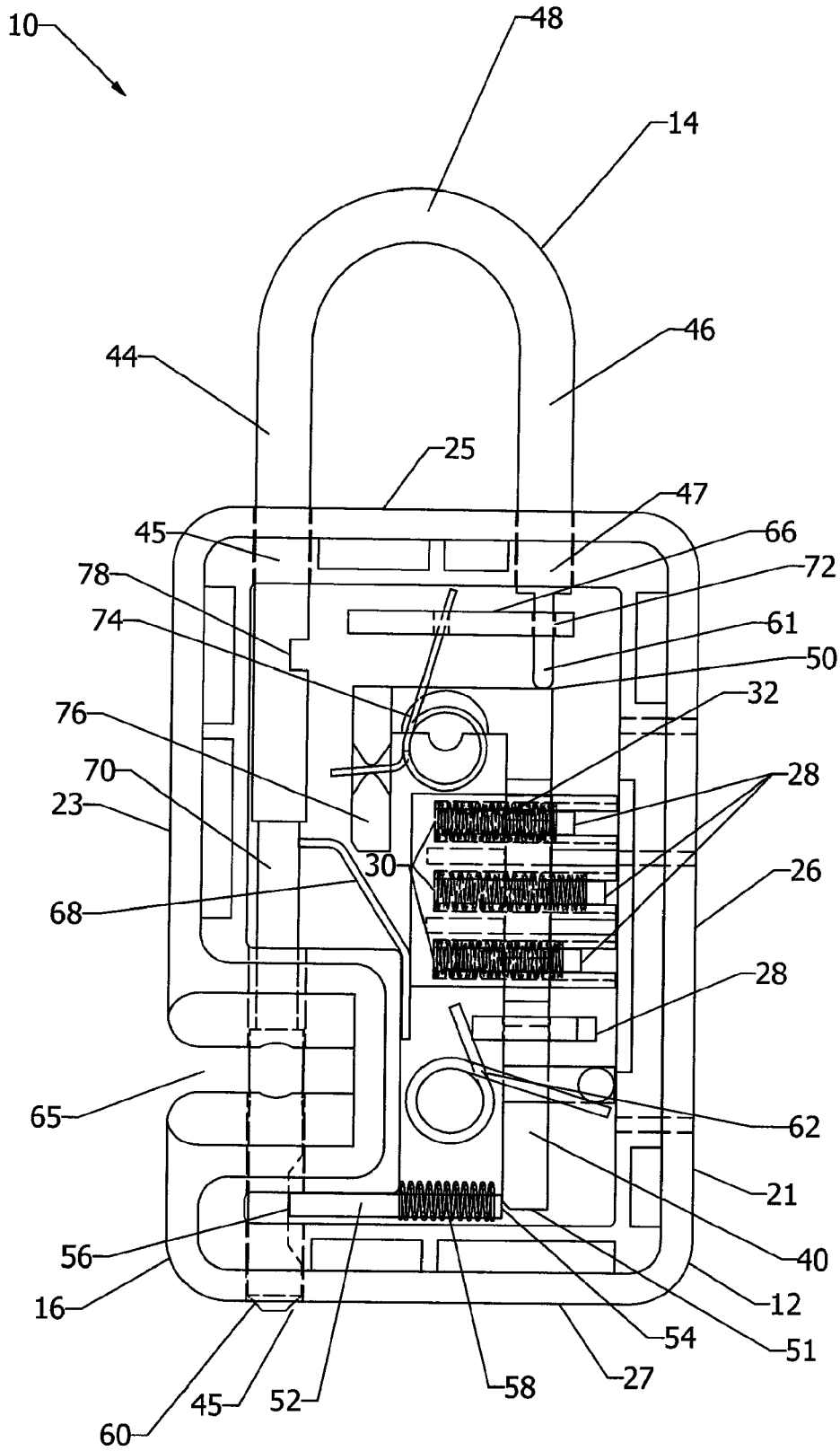
FIG. 6 is a front cross sectional view of the padlock of FIG. 1 in a third step of the primary closing process.
Figure 7:
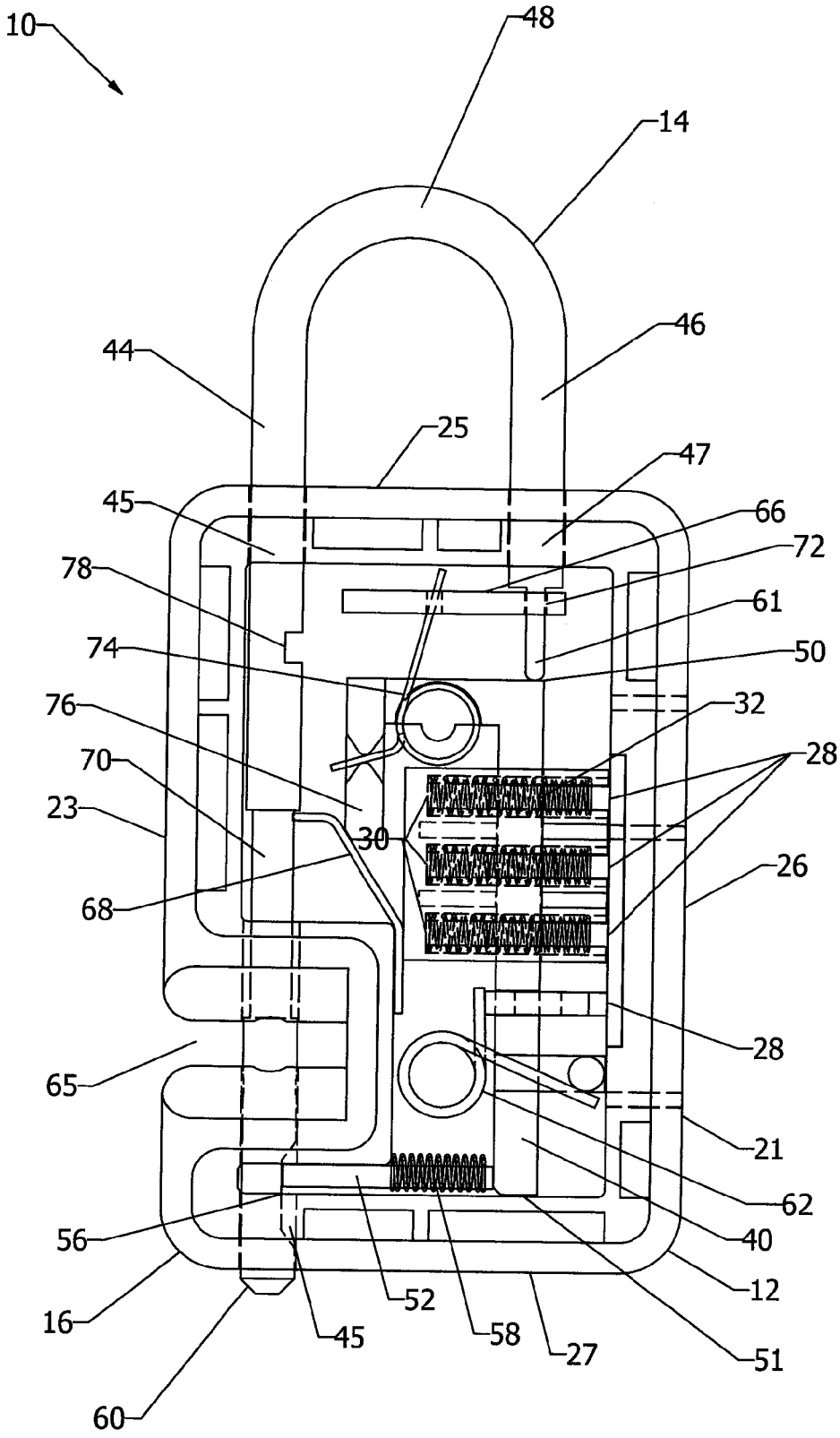
FIG. 7 is a front cross sectional view of the padlock of FIG. 1 in the primary closed position.
Figure 8:
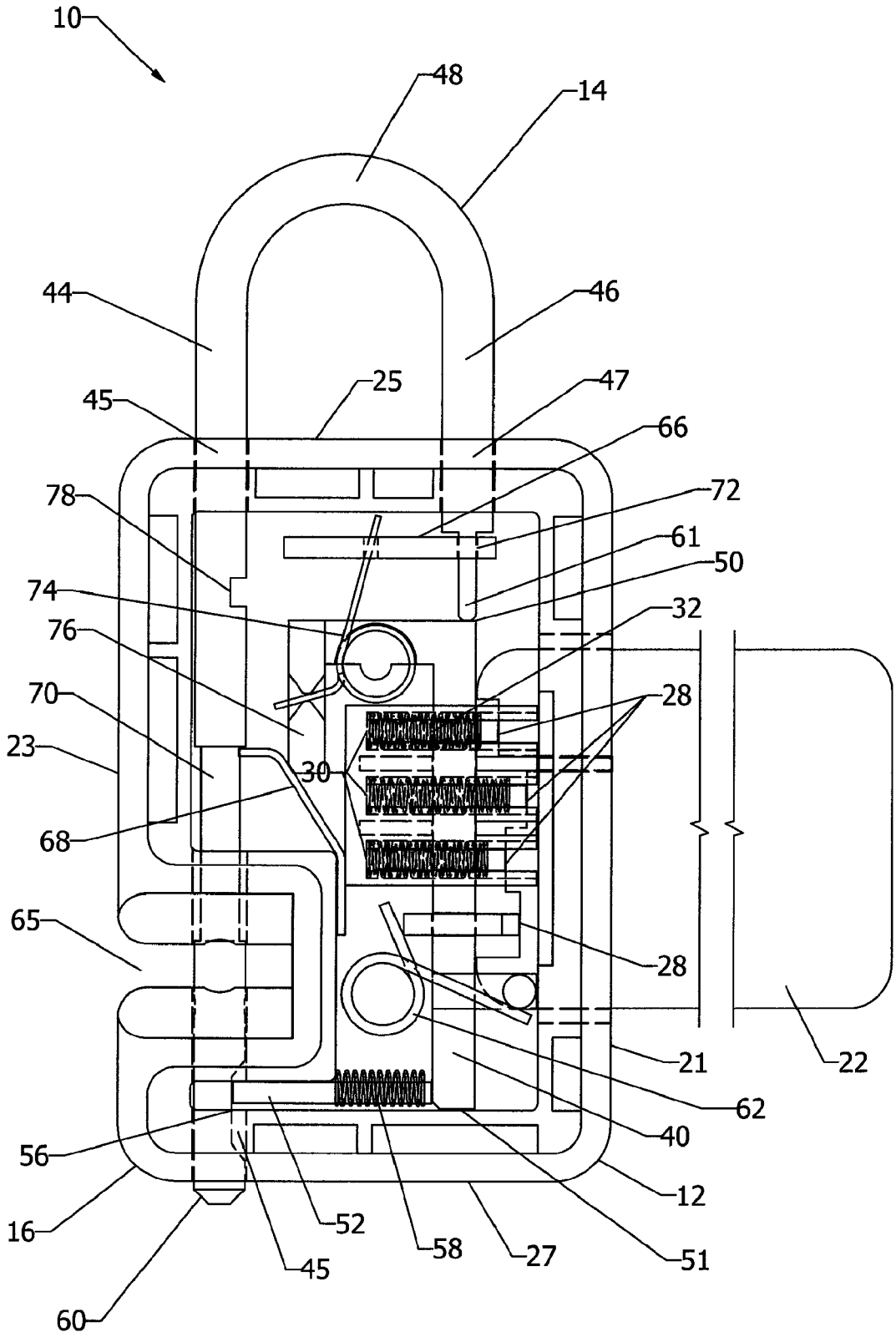
FIG. 8 is a front cross sectional view of the padlock of FIG. 1 in a first step of the primary opening process.
Figure 9:
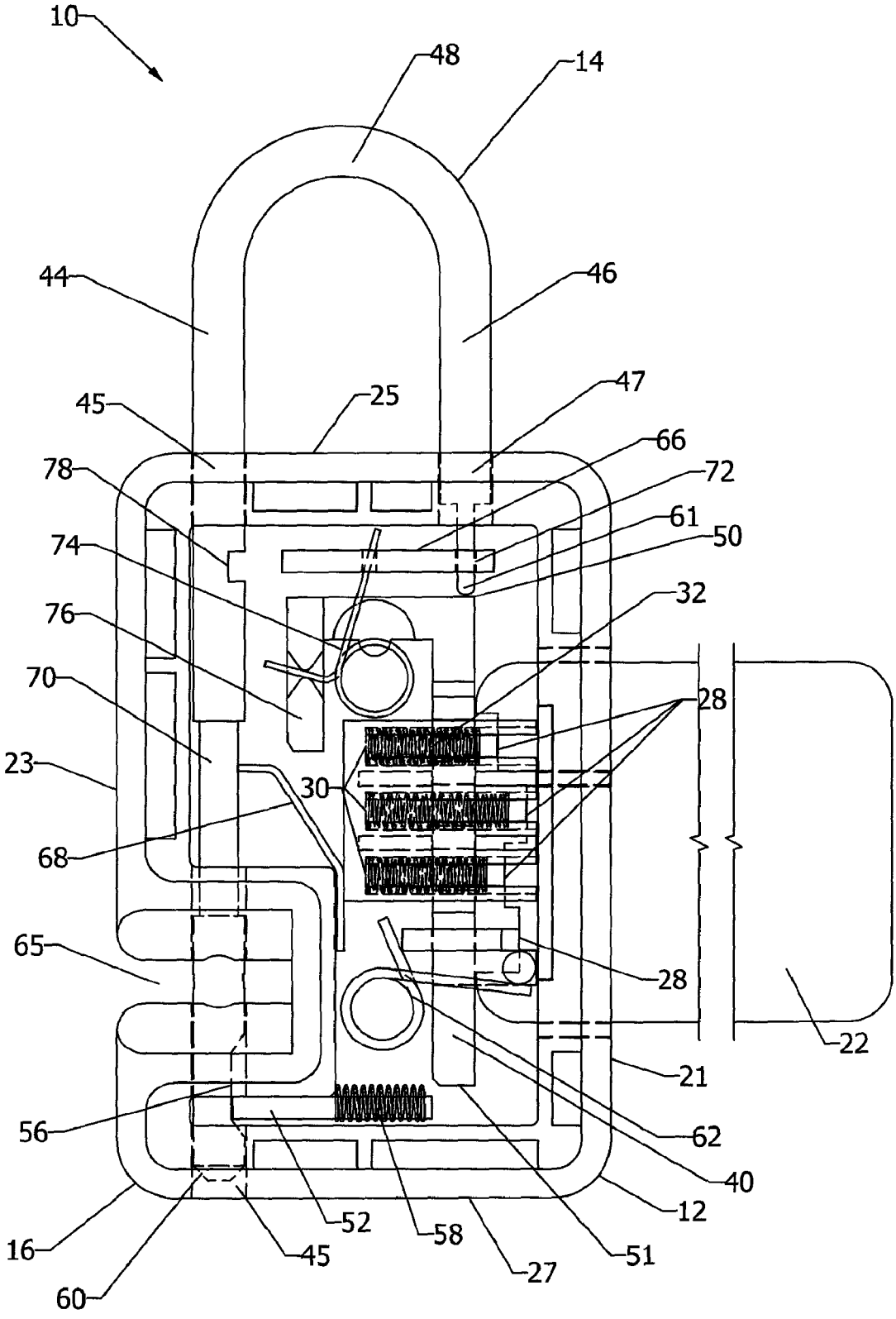
FIG. 9 is a front cross sectional view of the padlock of FIG. 1 in a second step of the primary opening process.
Figure 10:
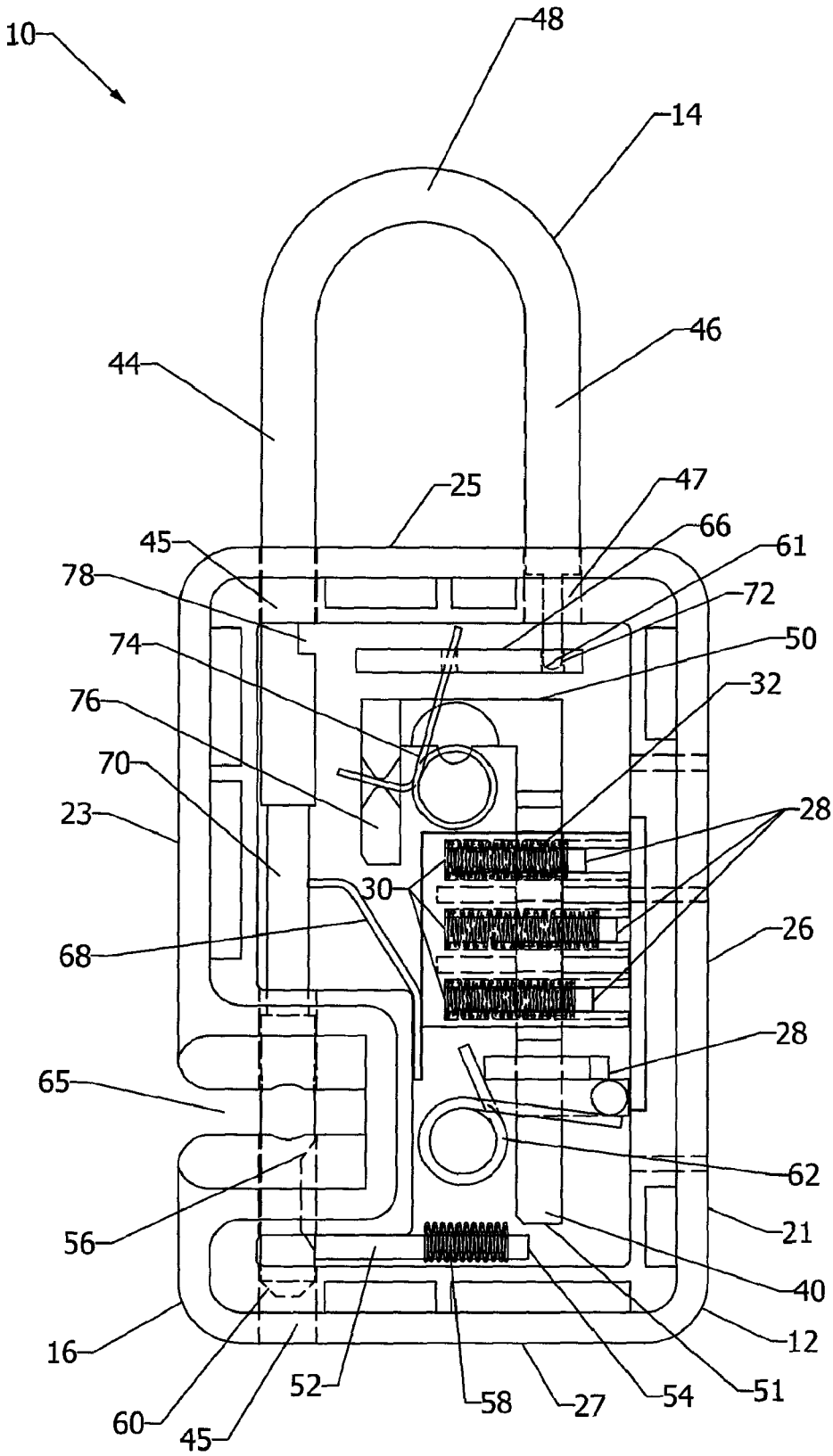
FIG. 10 is a front cross sectional view of the padlock of FIG. 1 in a third step of the primary opening process.

The bar 40 and the primary latch member 52 interact to allow the shackle 14 to move back and forth between a primary open position (as shown in FIG. 3) and a primary closed position (as shown in FIG. 7). In the primary open position, the raised portions 42 of the bar 40 are received in the openings 36 in the wafers 28. To move towards the primary closed position, the shackle 14 is pushed into the housing 16 (as shown in FIG. 4) until the distal end 60 of the first side 44 of the shackle 14 contacts the first end of the primary latch member 52. The distal end 60 is tapered such that the distal end 60 pushes the primary latch member 52 along the slot 54. As shown in FIG. 5, the primary latch member 52 is then pushed back into the first notch 56 by the primary latch spring 58.

As also shown in FIG. 5, the distal end 61 of the second side 46 of the shackle 14 engages the first end 50 of the bar 40 and pushes the bar 40 in the same direction as the shackle 14. The raised portions 42 are moved out of the openings 36 in the wafers 28 until the wafers 28 are then free to be moved by the wafer springs 32. The wafers 28 then move such that the openings 36 are out of alignment with the bar 40 and the bar 40 is thereby prevented from further movement. The second end 51 of the bar 40 is now adjacent the second end of the primary latch member 52, thereby preventing the primary latch member 52 from moving away from the first side 44 of the shackle 14. The shackle 14 is now in the primary closed position.

The shackle 14 can be moved back to the primary open position by insertion of the key 22. The engaging portions 34 of the key 22 engage with the wafers 28 and move the wafers 28 by the correct distances such that the openings 36 therein align with the bar 40. The raised portions 42 are then free to move through the openings 36. The key 22 also engages in the key slot 26 with a slider spring 62 that in turn engages with the bar 40. The insertion of the key 22 into the key slot 26 thereby acts on the bar 40 to move it towards the end 61 of the second side 46 of the shackle 14. It is noted that the slider spring 62 also acts against the endmost wafer 28 to form the function of the wafer spring for that wafer.

The movement of the bar 40 towards the shackle 14 releases the primary latch member 52 so that it is free to ride up out of the first notch 54 and release the shackle 14 and the first end 50 of the bar 40 engages with the distal end 61 of the second side 46 of the shackle 14 to move the shackle 14 towards the primary open position.

The housing 16 of the padlock 12 includes a port 65 through which a portion of the first side 44 of the shackle 14 is exposed. The port 65 is provided such that the first side 44 of the shackle 14 can be severed with an appropriate tool, such as bolt cutters, thereby releasing the shackle 14 from the primary closed position to a secondary open position. The locking mechanism 10 is also provided with a secondary latch member 66 for securing the shackle 14 when moved from the secondary open position to a secondary closed position.

Figure 11:
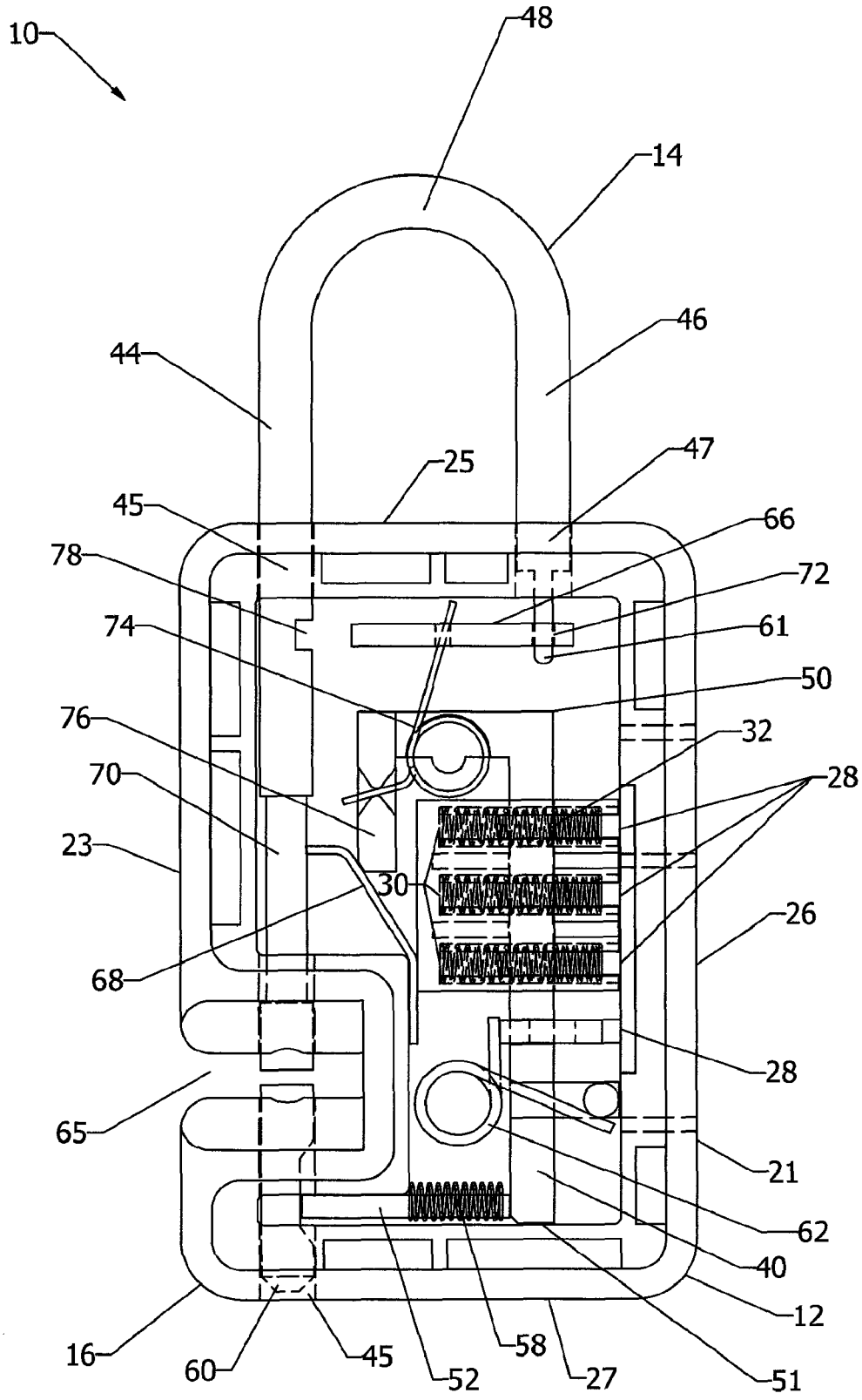
FIG. 11 is a front cross sectional view of the padlock of FIG. 1 in a first step of the secondary opening process.

The port 65 is provided such that the first side 44 of the shackle 14 can be severed adjacent the first notch 56 such that the portion of the first side 44 having the first notch 56 is retained and the remainder of the shackle 14 is then free to move to the second open position (as can be seen in FIG. 11).

Figure 12:
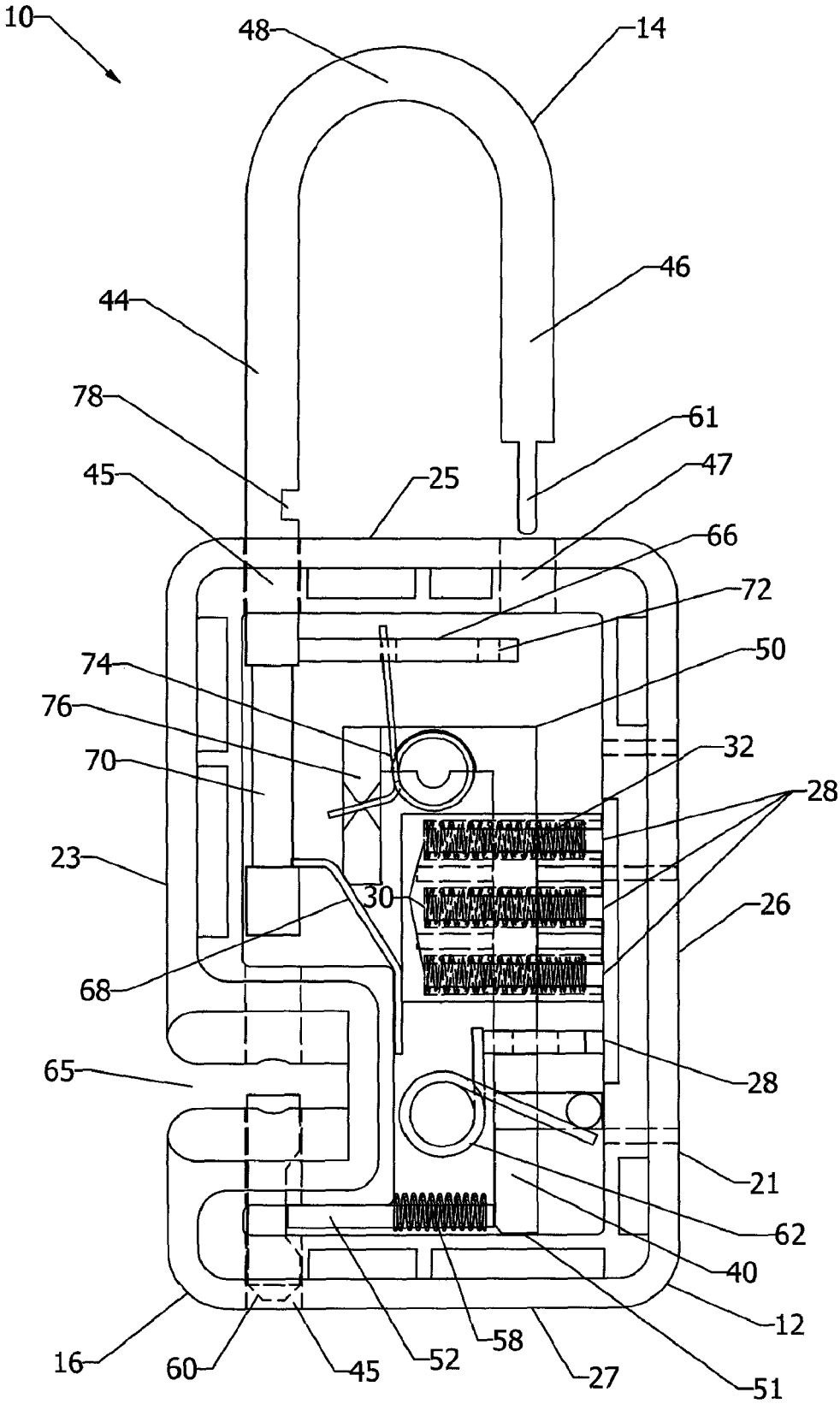
FIG. 12 is a front cross sectional view of the padlock of FIG. 1 in the secondary open position.

A shackle retainer 68 is provided to prevent the severed shackle 14 from completely exiting the housing 16. The shackle retainer 68 comprises a flexible strip of material, a first end of which is secured inside the housing 16 and a second end of which rests against the first side 44 of the shackle 14. The second end engages with the first side 44 in a thinned portion 70 thereof such that when the severed shackle 14 moves outwardly of the housing 16, the second end engages with the edge of the thinned portion 70 to prevent complete removal of the shackle 14 from the housing 16 (as shown in FIG. 12).

The secondary latch member 66 comprises an elongate member slidably located in a slot provided extending between the first and second sides 44 and 46 of the shackle 14 adjacent the first end wall 25 of the housing 16. In the primary open and closed configurations, the secondary latch member 66 is adjacent the second side 46 of the shackle 14 and includes a cut out portion 72 provided such that the second side 46 of the shackle slides through the cut out portion 72. When the second side 46 has passed through the cut out portion 72, the secondary shackle member 66 is prevented from sliding towards the first side 44 of the shackle 14.

A secondary latch spring 74 is provided in engagement with a transverse end portion 76 provided extending from the first end 50 of the bar 40. Movement of the bar 40 away from the shackle 14 when moving to the primary closed position thereby moves the secondary latch spring 74 such that it engages with the secondary latch member 66 applying a force to move the secondary latch member 66 towards the first side 44 of the shackle 14. As the second side 46 of the shackle 14 is received in the cut out portion 72 however, the force of secondary latch spring 74 does not move the secondary latch member 66.

Figure 13:
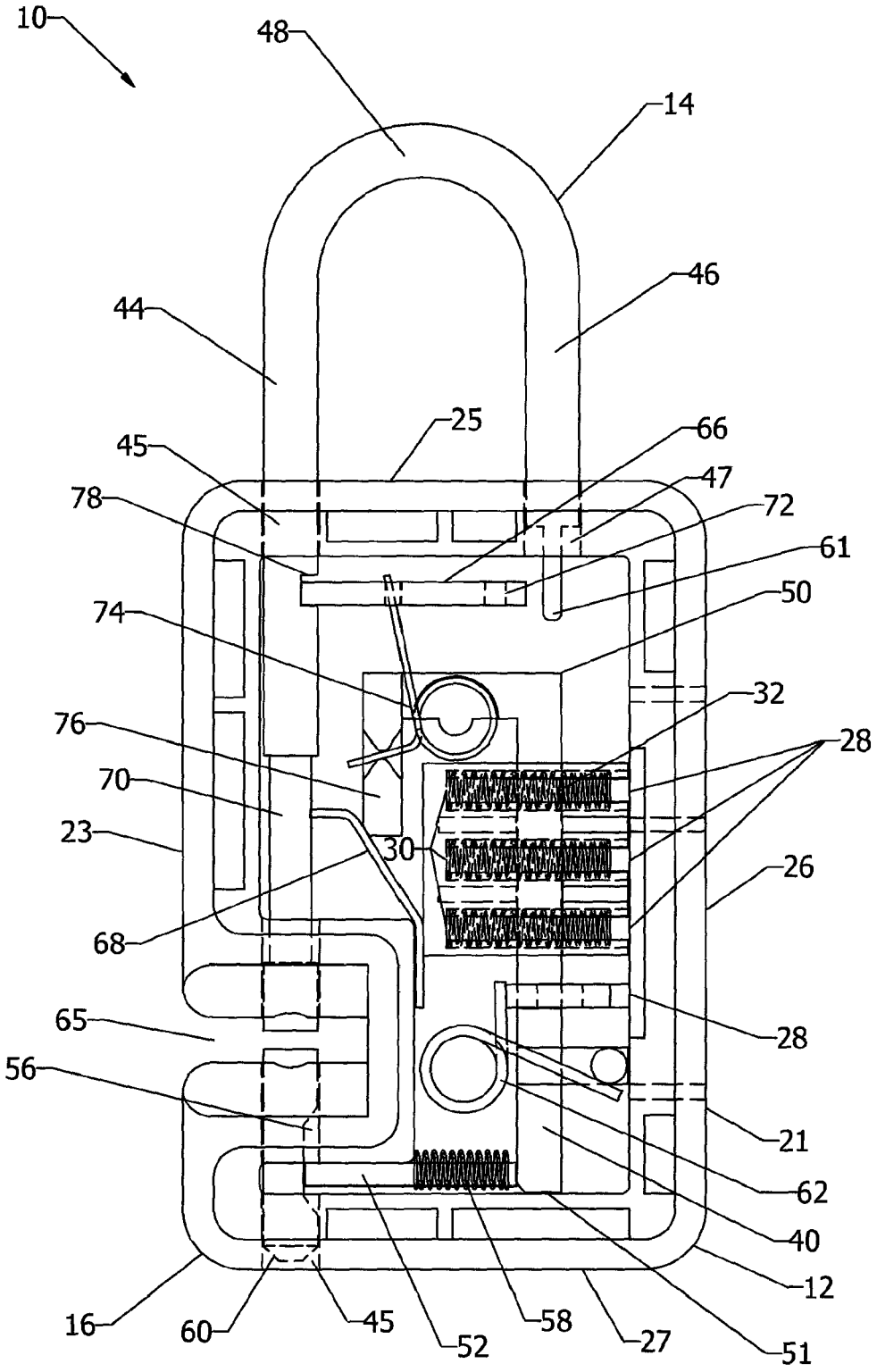
FIG. 13 is a front cross sectional view of the padlock of FIG. 1 in the secondary closed position.

When the shackle 14 has been severed, the bar 40 is still in the locked position. When the shackle 14 moves out of the housing 16, the second side 46 thereof disengages from the cut out portion 72. The secondary latch member 66 is therefore moved towards the first side 44 of the shackle 14 to engage therewith. A second notch 78 is provided in the first side 44 of the shackle 14 such that the second notch 78 is out of the housing 16 when the shackle 14 is in the secondary open position. The shackle 14 can therefore be pushed back into the housing 16 and the secondary latch member 66 engages with the second notch 78 to hold the shackle 14 in the secondary closed position (as can be seen in FIG. 13.

Figure 14:
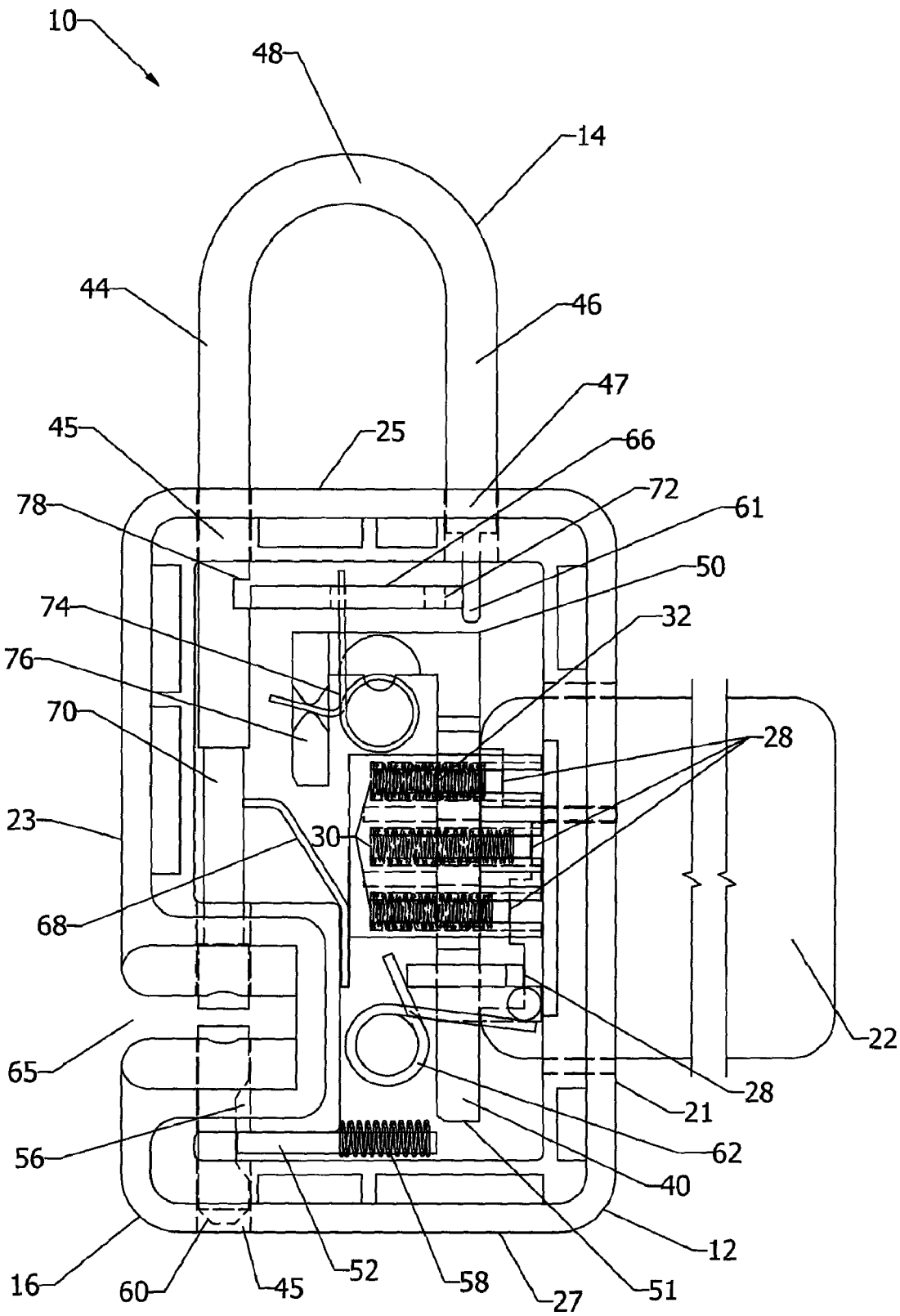
FIG. 14 is a front cross sectional view of the padlock of FIG. 1 in a first step of opening from the secondary closed position.
Figure 15:
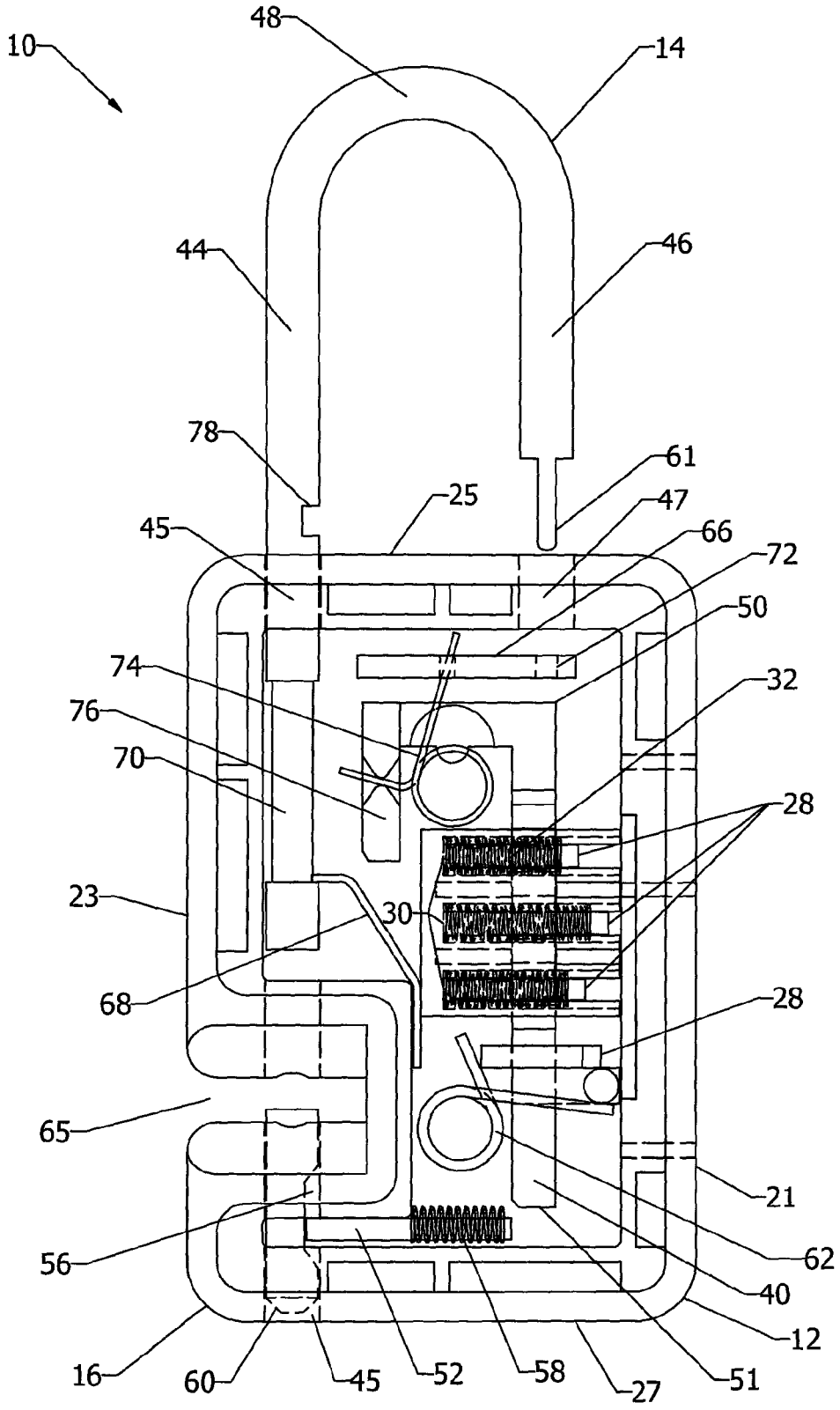
FIG. 15 is front cross sectional view of the padlock of FIG. 1 opened from the secondary closed position.
Figure 16:
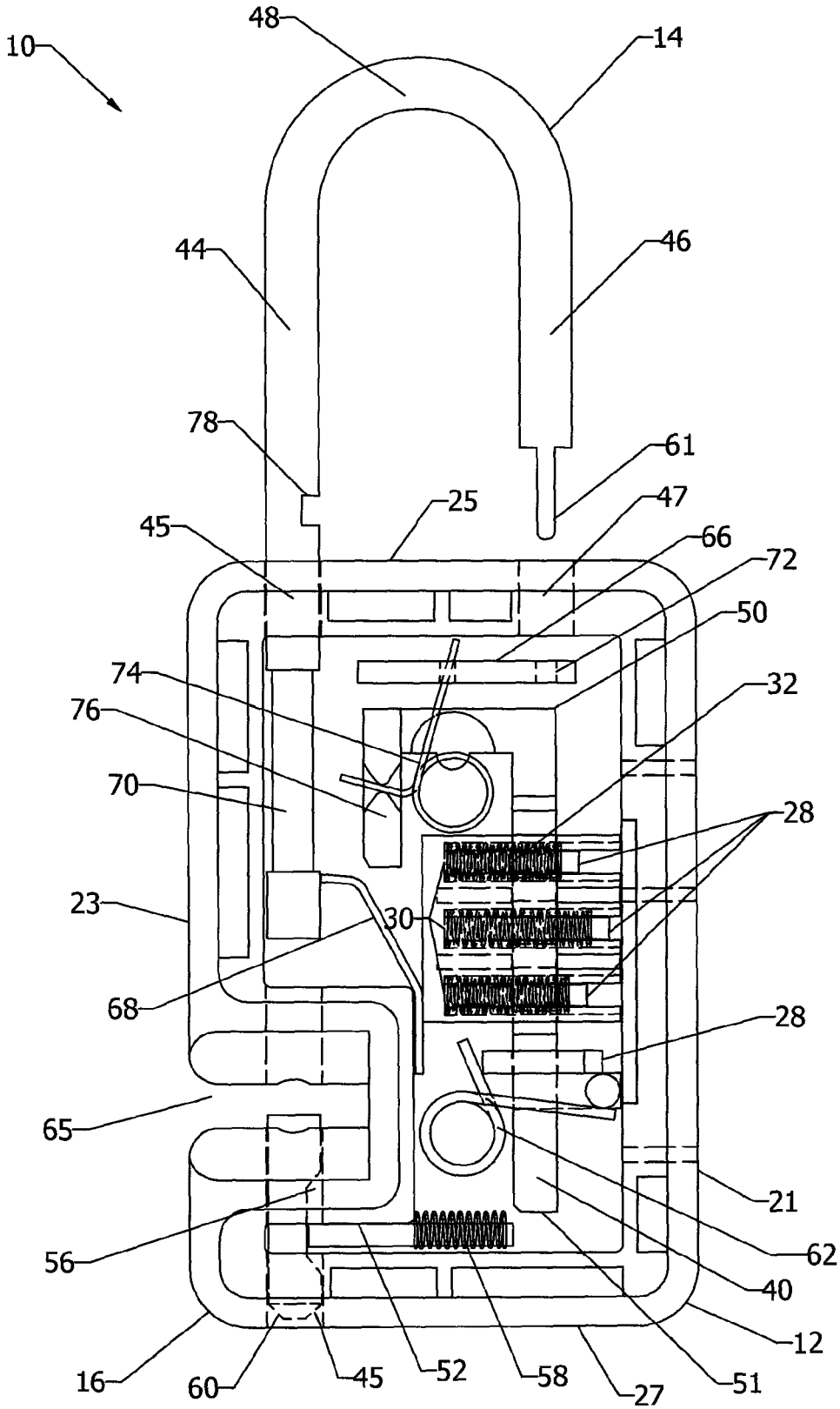
FIG. 16 is front cross sectional view of the padlock of FIG. 1 showing removal of the shackle.

From the secondary closed position, inserting the key 22 as described above allows the bar 40 to move towards the shackle 14 again. This motion acts on the secondary latch spring 74 to move it such that it pulls the secondary latch member 66 out of the secondary closed position (as shown in FIG. 14). From here, the severed shackle 14 can be pulled completely from the housing 16 by supplying enough force to flex the shackle retainer 68 (as shown in FIG. 16).

Figure 17:
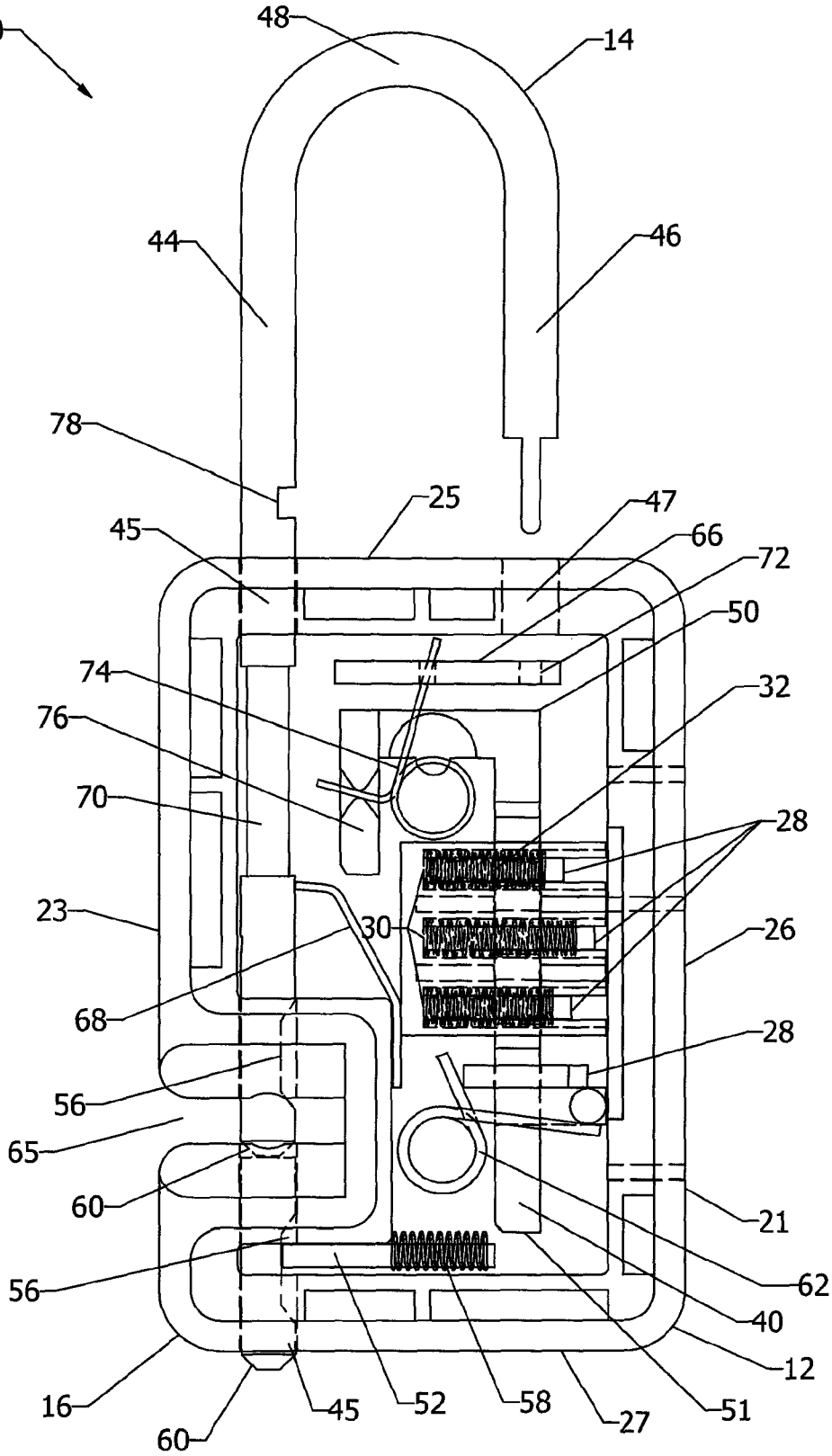
FIG. 17 is front cross sectional view of the padlock of FIG. 1 showing insertion of a replacement shackle.

A replacement shackle 14 can then be inserted by sliding the first side thereof into the first recess 45 as shown in FIG. 17. The distal end 61 of the second side 46 of the shackle 14 and the corresponding second recess 47 are thinner than the first side 44 and first recess 45 in order to prevent the replacement shackle 14 being inserted the wrong way around. The distal end 60 of the first side 44 engages with remaining portion of the severed shackle 14. The force applied causes the primary latch member 52 to ride out of the first notch 56 releasing the remaining portion. The remaining portion of the severed shackle 14 is thereby pushed out of the second end edge 27 of the housing 16.

In use, the padlock 12 can be operated to lock and unlock in a standard manner. The shackle is moved to the primary closed position by pushing it into the housing 16 in a normal manner and unlocked to the primary open position by inserting the key 22 as described previously.

If it is necessary for the padlock to be opened by someone without the key 22, such as a security staff member in an airport, that person can clip the shackle 14 through the port 65. The shackle 14 will then move to the secondary open position, allowing access to luggage secured by the padlock 12. The padlock can then still be closed by pushing the shackle 14 back into the housing to the secondary closed position. From this position, the owner of the padlock can not only still open the padlock 12 with the key 22 but has a visible indication that the padlock has been opened by the visibly severed shackle 14 in the port 65. When opened again by the owner with the key 22, the severed shackle 14 can also be replaced as described to return the padlock 12 to the original working configuration.

It will be readily apparent to persons skilled in the relevant arts that various modifications and improvements may be made to the foregoing embodiments, in addition to those already described, without departing from the basic inventive concepts of the present invention.

What is claimed is:

1. A locking mechanism comprising;

a housing;

a shackle having a first side and a second side, the shackle being slidable between a primary closed position in which the first and second sides are located in respective first and second recesses in a first end of the housing and engaged with the housing and a primary open position in which the first side is located in the first recess and engaged with the housing and the second side is free from the second recess in the housing; and a port in a side of the housing located between the first end and a second remote end thereof, the port exposing a portion of the first side of the shackle in the primary closed position;

wherein severing the shackle through the port allows the shackle to move from the primary closed position to a secondary open position, from which the shackle can move back to a secondary closed position.

2. The locking mechanism in accordance with claim 1, further comprising:

a primary latch member that engages with the shackle in the primary closed position and is releasable from the shackle by operation with a key; and a secondary latch member that is disengaged from the shackle in the primary open and closed positions;

wherein severing of the shackle and movement of the shackle to the secondary open position releases the secondary latch member such that the secondary latch member is free to engage with the shackle when the shackle moves to the secondary closed position.

3. The locking mechanism in accordance with claim 2, wherein the shackle can be opened from the secondary closed position by operation with the key and the shackle can then be removed from the housing for replacement.

4. The locking mechanism in accordance with claim 3, wherein the first side of the shackle is longer than the second side and the primary latch member is slidable in a slot in the housing in a direction perpendicular to that of the first side of the shackle such that when the shackle moves to the primary closed position, a first end of the primary latch member is received in a first notch in the first side of the shackle adjacent the end thereof.

5. The locking mechanism in accordance with claim 4, wherein the primary latch member includes a primary latch spring arranged in the slot to bias the primary latch member to move towards the first side of the shackle.

6. The locking mechanism in accordance with claim 5, wherein the first notch includes tapered sides such that when the shackle slides from the primary closed position, the primary latch member can ride up out of the first notch.

7. The locking mechanism in accordance with claim 6, wherein a slide member is provided, the slide member being moveable between a first locked position and a second unlocked position by insertion of the key into the housing and wherein in the first locked position the slider engages with the primary latch member to prevent the primary latch member moving out of the first notch, thereby preventing the shackle moving to the primary open position.

8. The locking mechanism in accordance with claim 7, wherein the slide member comprises a slidable bar, the first end of which engages with a distal end of the second side of the shackle when moving to the second unlocked position to move the shackle towards the primary open position.

9. The locking mechanism in accordance with claim 8, wherein the second end of the slidable bar engages with the primary latch member in the primary closed position to prevent movement of the primary latch member out of the first notch.

10. The locking mechanism in accordance with claim 2, further comprising:

a slot extending between the first and second sides of the shackle into which the secondary latch member is slidably located;

a cut out portion in the secondary latch member such that the second side of the shackle engages through the cut out portion when in the primary closed position;

a secondary latch spring; and a second notch provided in the first side of the shackle;

wherein movement of a bar to the locked position thereof moves the secondary latch spring to apply a force to move the secondary latch member towards the first side of the shackle and moving the severed portion of the shackle releases the secondary latch member to move towards the first side of the shackle where it can engage in the second notch when moved back to the secondary closed position.

11. The locking mechanism in accordance with claim 1, wherein the housing includes first and second end walls and first and second side walls and the first end wall includes the first and second recesses for receiving the first and second sides of the shackle.

12. The locking mechanism in accordance with claim 11, wherein the first recess is located adjacent the second side wall, the second recess is located adjacent the first side wall and the port is located in the second side wall.

13. The locking mechanism in accordance with claim 12, wherein a bar is located adjacent the first side wall being collinear with the second side of the shackle and the first side wall is provided with a key slot for receiving a key to engage with and release the bar from the locked position to the unlocked position.

14. The locking mechanism in accordance with claim 1, wherein a shackle retainer is provided to retain the severed shackle in the housing.

15. The locking mechanism in accordance with claim 14, wherein the shackle retainer comprises a flexible strip of material, a first end of which is secured inside the housing and a second end of which rests against the first side of the shackle in a thinned portion thereof such that when the severed shackle moves outwardly of the housing, the second end engages with the edge of the thinned portion to prevent complete removal of the shackle from the housing.

* * * * *